US009353592B2

(12) United States Patent
Kekarainen

(10) Patent No.: US 9,353,592 B2
(45) Date of Patent: May 31, 2016

(54) SUBSEA XMAS TREE ASSEMBLY AND ASSOCIATED METHOD

(71) Applicant: Aker Subsea AS, Lysaker (NO)

(72) Inventor: Jarmo Kekarainen, Valbo (SE)

(73) Assignee: Aker Subsea AS, Lysaker (NO)

( * ) Notice: Subject to any disclaimer, the term of this patent is extended or adjusted under 35 U.S.C. 154(b) by 0 days.

(21) Appl. No.: 14/440,055

(22) PCT Filed: Nov. 15, 2013

(86) PCT No.: PCT/NO2013/050197
§ 371 (c)(1),
(2) Date: Apr. 30, 2015

(87) PCT Pub. No.: WO2014/081310
PCT Pub. Date: May 30, 2014

(65) Prior Publication Data

US 2015/0247371 A1 Sep. 3, 2015

(30) Foreign Application Priority Data

Nov. 21, 2012 (NO) ..... 20121389

(51) Int. Cl.
*E21B 33/035* (2006.01)

(52) U.S. Cl.
CPC ..... *E21B 33/035* (2013.01)

(58) Field of Classification Search
CPC ..... E21B 33/035; E21B 33/043; E21B 34/04; E21B 23/00; E21B 33/064; E21B 33/03; E21B 33/068; E21B 34/02
USPC ..... 166/339, 343, 344, 345, 348, 350, 368, 166/382, 386
See application file for complete search history.

(56) References Cited

U.S. PATENT DOCUMENTS

| | | | | |
|---|---|---|---|---|
| 4,342,363 | A | 8/1982 | Reed | |
| 4,807,700 | A * | 2/1989 | Wilkins | E21B 33/04 166/332.4 |
| 5,887,658 | A | 3/1999 | Tison | |
| 6,186,237 | B1 | 2/2001 | Voss, Jr. et al. | |
| 6,367,551 | B1 * | 4/2002 | Fenton | E21B 33/038 166/345 |
| 6,378,613 | B1 | 4/2002 | Kent et al. | |
| 7,121,344 | B2 | 10/2006 | Fenton et al. | |
| 2003/0150620 | A1 * | 8/2003 | DeBerry | E21B 33/043 166/368 |
| 2006/0260799 | A1 * | 11/2006 | Broussard | E21B 23/01 166/75.14 |
| 2007/0289745 | A1 | 12/2007 | Richards | |
| 2010/0319933 | A1 | 12/2010 | Baugh | |
| 2012/0037374 | A1 | 2/2012 | Schuurman et al. | |

OTHER PUBLICATIONS

Løvås, Bjørn, "International Search Report." prepared for PCT/NO2013/050197, as mailed Feb. 5, 2014, three pages.

* cited by examiner

*Primary Examiner* — James G Sayre
(74) *Attorney, Agent, or Firm* — Winstead PC

(57) ABSTRACT

Subsea Xmas tree assembly (5, 505) having a Xmas tree main bore (7) and a Xmas tree annulus bore (9). The main bore (7) aligns with a tubing hanger main bore (16) and the Xmas tree annulus bore (9) communicates with a tubing hanger annulus bore (17), when the Xmas tree assembly (5, 505) is installed above a tubing hanger (3) of a subsea well. The subsea Xmas tree assembly (5, 505) comprises a plug tool (100) adapted to install and to retrieve a plug (200) into and out of the tubing hanger annulus bore (17) when the Xmas tree assembly (5, 505) is installed above the tubing hanger (3). The assembly has a tool accommodation compartment (118, 618) within which the plug tool (100) is arranged. An associated method is also described.

14 Claims, 12 Drawing Sheets

SUBSEA XMAS TREE ASSEMBLY AND ASSOCIATED METHOD

The present invention relates to a subsea Xmas tree assembly for a subsea hydrocarbon well. In particular it relates to a Xmas tree assembly adapted for closing and opening an annulus bore in a tubing hanger below the Xmas tree assembly.

BACKGROUND

In the field of subsea oil and gas production it is known to arrange a subsea Xmas tree (XT) on the seabed, on top of a subsea well extending into the seabed. The XT controls the flow of fluids, in particular produced hydrocarbons flowing out from the well. When used on an injection well, it controls fluid injected into the well. Moreover it constitutes a barrier between the well and the environment. It is known to connect the XT to a wellhead or a tubing head spool at the top of the well. For conventional Xmas trees, also referred to as vertical Xmas trees, a tubing hanger (TH) is hung off in the wellhead or the tubing head spool below the XT. The tubing head spool is an adapter unit in between the wellhead and the vertical XT usually featuring an annulus isolation valve.

The type of XT which will be discussed herein is the type known as a vertical Xmas tree having two bores. One bore is a main bore, known as a production or injection bore. The second bore is normally referred to as the annulus bore which communicates with the tubing annulus. The tubing annulus is the annular space between the production tubing and the well casing. The tubing annulus is also referred to as the annulus A. There is also an annulus B which is the interspace between the inner casing (outside the tubing) and the next casing. The annulus bore in the XT communicates with an annulus in the wellhead, through a bore extending vertically through the TH and through a part of the Xmas tree main body. A vertical (conventional) dual bore XT has access to the TH main bore (production/injection bore) and the TH annulus bore, through dual bores that extend through the XT main body. These bores are accessible from topside to allow plugs to be set by wireline through a workover riser, e.g.

Normally the wellhead dimensions are considered as an industry standard which is widely spread. The dimensions thus restrict the possibility to redesign the wellheads to allow larger production/injection bores through the stack of wellhead, TH, and XT.

The limited space available here limits the possible space for a vertical annulus path to enable wireline operations from topside in the TH through Xmas tree.

After running the completion of the TH and the tubing, the wellhead or the tubing head spool is temporarily isolated until the XT is landed and connected. This means that the production bore and the annulus bore of the TH are isolated by running a plug in the respective bores. This is a conventional method for isolation of an abandoned well.

The dual bore design of a vertical XT allows access for a wireline tool to set and unset a plug in a plug-profile in the annulus bore in TH. However, in the case of a XT with a deviated annulus bore, the wireline tool cannot access the TH annulus bore. In such cases the technology of prior art uses a valve in the TH or in a tubing head spool to constitute isolation of the annulus.

US patent publication U.S. Pat. No. 7,121,344 discloses a plug tool which is adapted to land on top of a XT, and extend a stem through the XT in order to set or retrieve a plug in the bore of the TH.

THE INVENTION

According to a first aspect of the present invention there is provided a subsea Xmas tree assembly having a Xmas tree main bore and a Xmas tree annulus bore. The Xmas tree main bore is adapted to align with a tubing hanger main bore and the Xmas tree annulus bore is adapted to communicate with a tubing hanger annulus bore, when the Xmas tree assembly is installed above a tubing hanger of a subsea well. According to the first aspect of the present invention, the subsea Xmas tree assembly comprises a plug tool adapted to install and to retrieve a plug into and out of the tubing hanger annulus bore when the Xmas tree assembly is installed above the tubing hanger. Furthermore, the subsea Xmas tree assembly comprises a tool accommodation compartment within which the plug tool is arranged.

The plug tool may comprise a tool stem which is adapted to be moved towards and away from the tubing hanger annulus bore, in an axial direction with respect to the tubing hanger annulus bore.

The tool stem may be supported in a tool cylinder which is accommodated by the Xmas tree assembly.

The tool cylinder can be releasably fixed to the Xmas tree assembly and be accommodated in said tool accommodation compartment.

The tool cylinder can advantageously comprise a cylinder bore within which a tool piston is arranged. The tool piston is then connected to the tool stem, so that movement of the tool piston and tool stem is provided by supply of hydraulic pressure above or below said tool piston.

In embodiments that involve a tool stem, a lower part of the tool stem can comprise a locking plunger arranged within a stem bore in the tool stem. The locking plunger is then adapted to be moved downwards with respect to the tool stem by application of hydraulic pressure in the stem bore above the locking plunger. The locking plunger is further adapted to activate stem locking means for locking the tool stem to the plug when the locking plunger is moved downwards. This is one way to provide releasable attachment of the plug to the plug tool.

In such an embodiment the stem locking means can advantageously comprise a stem dog exhibiting an inclined stem dog actuation face that is adapted to slide against a plunger actuation face of the locking plunger.

In a further embodiment of the first aspect of the present invention, the plug may take a plug parking position in which the plug is maintained during fluid communication between the Xmas tree annulus bore and the tubing annulus. This parking position is within a tool bore that aligns with the tubing hanger annulus bore. Moreover, the parking position is above a channel in the Xmas tree assembly that connects the Xmas tree annulus bore with the tool bore.

In yet an embodiment the subsea Xmas tree assembly comprises an isolation sleeve or an orientation sleeve arranged below a Xmas tree master valve block. Moreover, the plug tool can be arranged in the Xmas tree master valve block. In another embodiment, the plug tool is arranged in the isolation sleeve or the orientation sleeve.

It should be appreciated by the person skilled in the art, that the present invention also involves embodiments where the XT assembly does not comprise such an isolation or orientation sleeve. In such embodiments the plug tool can be accommodated in the master valve block of the XT assembly.

According to a second aspect of the present invention, there is provided a method of opening for fluid communication between a Xmas tree annulus bore and a tubing annulus of a subsea well through a tubing hanger annulus bore of a tubing hanger. According to the invention, the method comprises the following steps a) landing a Xmas tree assembly on said well, above the tubing hanger;

b) with a plug tool being part of the Xmas tree assembly, connecting the plug tool to a plug installed in the tubing hanger annulus bore;

c) with the plug tool, releasing the plug from the tubing hanger annulus bore and pulling it up from the tubing hanger annulus bore and into the Xmas tree assembly.

In one embodiment of the second aspect of the invention, the step b) comprises i) lowering a tool stem down to the position of the plug; and ii) activating a stem locking means to lock a stem head to the plug.

The step i) above may involve supplying hydraulic pressure above a tool piston which is connected to the tool stem.

Also, the step c) of the second aspect of the invention may comprise retrieving the plug into a tool bore that aligns with the tubing hanger annulus bore.

Thus, the present invention enables the annulus plug to be operated by a plug setting and retrieving tool in the X-mas tree itself. In this manner, the operator is not dependent on wireline operation through the XT annulus bore to set a plug in the annulus bore of the TH. Thus, the XT may have a XT annulus bore which is a deviated XT annulus bore, while a plug can still be used to close the TH annulus bore.

After the XT landing sequence the annulus path through it and down to the tubing annulus (also referred to as the A-annulus) needs to be opened for control, bleed and monitoring of the annulus. The plug set and retrieval tool can pull the plug out of the annulus bore and open the communication between the annulus below the TH and the annulus path in the XT. The plug is pulled up and parked inside the Xmas tree assembly, in a parking position.

When the XT shall be retrieved, the tool sets the plug back into the TH annulus bore. The well can then be abandoned.

The plug can be replaced during workover operations with common wireline methods when the XT assembly is moved off the well.

One applicable plug is a plug commercially available from National Oilwell Varco, referred to as the Elmar plug. Depending on the embodiment the plug may need to be adapted to the solution in question, as will be understood by the person skilled in the art.

EXAMPLE OF EMBODIMENT

While the present invention has been described in general terms above, a more detailed description of an example of embodiment is given below with reference to the drawings, in which FIG. 1 shows a typical stackup of a wellhead, tubing hanger, and a vertical dual bore Xmas tree (XT) assembly;

Figure 1:
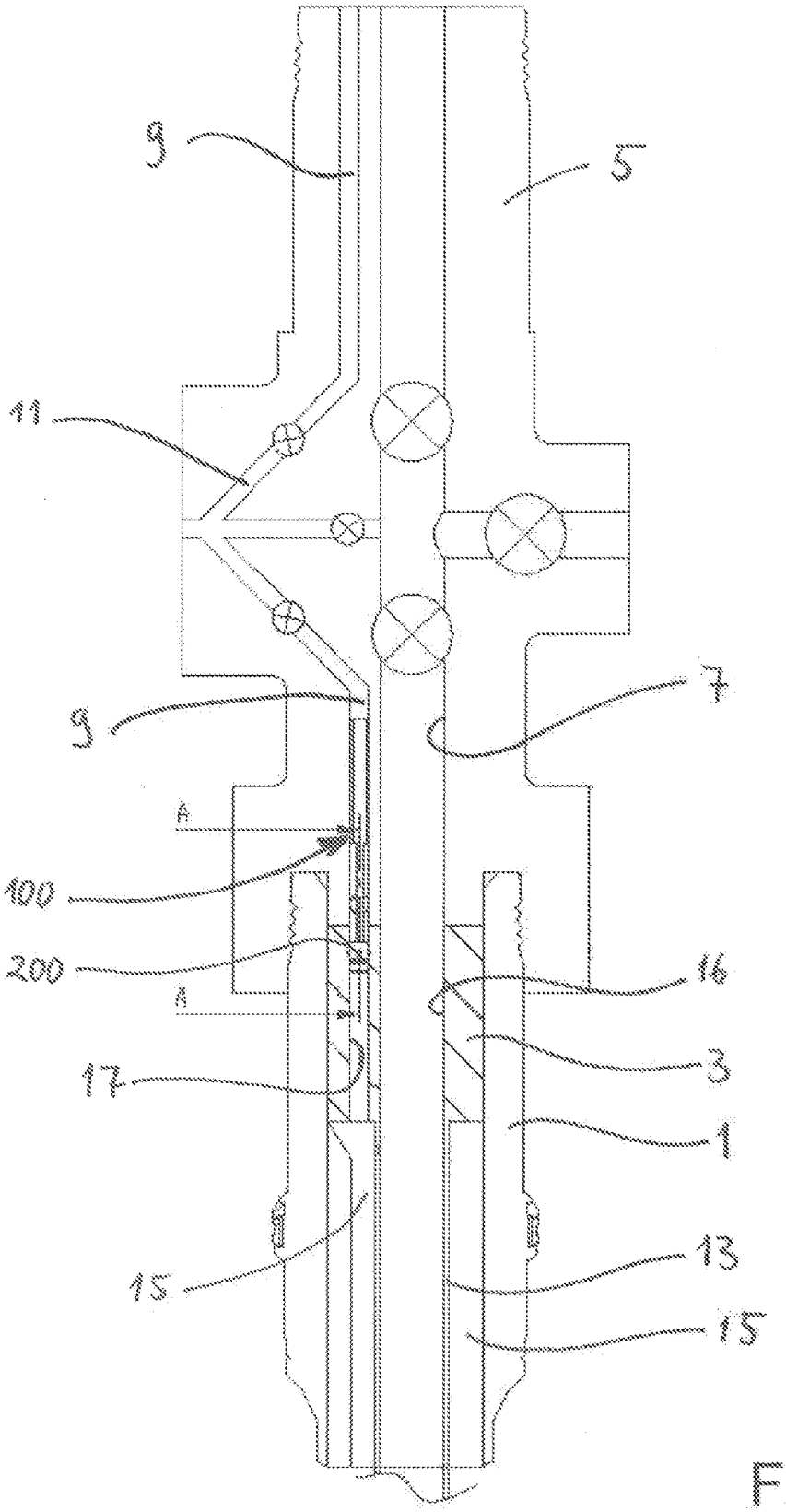

FIG. 1 shows, with a principle sketch, a typical subsea stack of a wellhead 1, tubing hanger (TH) 3, and a vertical Xmas tree (XT) assembly 5. The XT assembly 5 has a main bore or production bore 7 and an annulus bore 9. The XT annulus bore 9 has a deviated portion 11.

Down from the TH 3 depends a production tubing (or injection tubing) 13 into the well. Between the production tubing 13 and the well casing there is a tubing annulus 15 with which a TH annulus bore 17 communicates. The TH annulus 17 is aligned with the XT annulus bore 9 at the lower end of the XT 5. A TH main bore 16 aligns with the XT main bore 7.

In the lower end of the XT 5 there is indicated a plug tool 100. According to the principle drawing of FIG. 1, it appears that the tool is supported within the XT annulus bore 9. This is however not the case, as will appear from FIG. 2 and FIG. 3.

Figure 2:
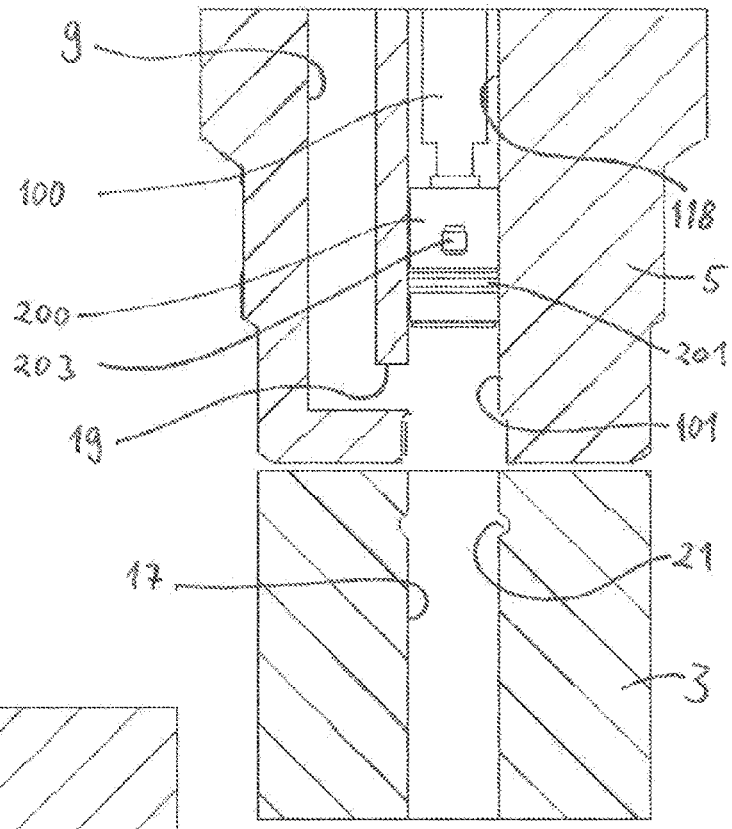
FIG. 2 is an enlarged cross section principle view of the lower part of the XT assembly and the upper part of the tubing hanger, with the annulus bore of the tubing hanger being open.
Figure 3:
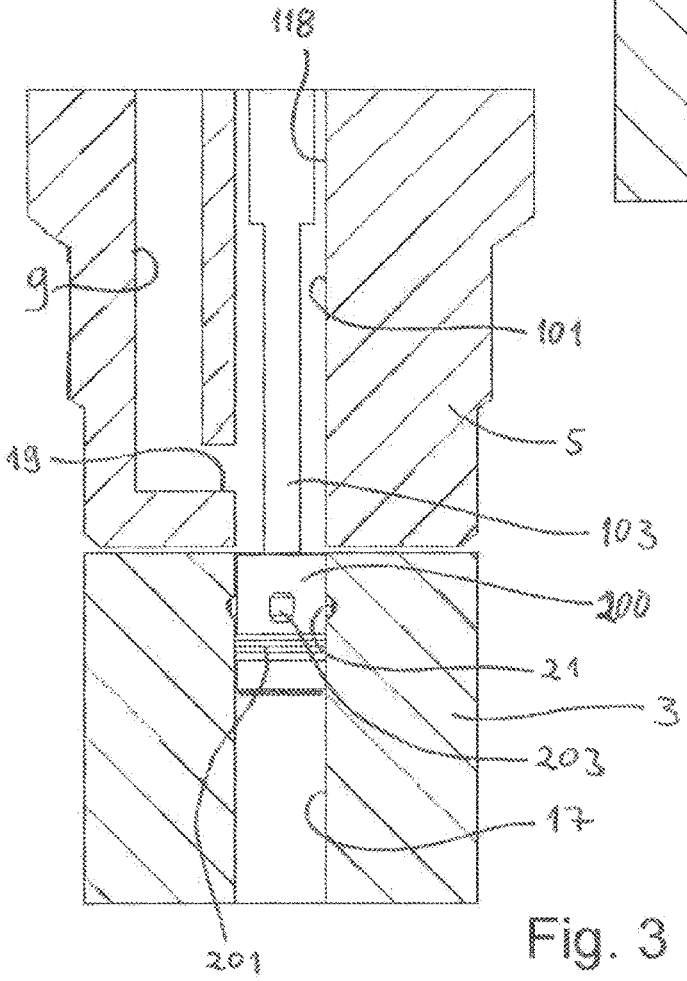
FIG. 3 is an enlarged cross section principle view corresponding to FIG. 2, however with a plug set in the annulus bore of the tubing hanger.

FIG. 2 and FIG. 3 are enlarged cross section views of the lower part of the XT 5 and the upper part of the TH 3, as seen from an angle orthogonal with respect to the cross section view of FIG. 1. The XT 5 comprises a tool accommodation compartment 118 within which the plug tool 100 is incorporated. In this embodiment, the tool accommodation compartment is in the form of a tool accommodation bore 118 arranged in the XT 5. The tool accommodation bore 118 extends parallel with respect to a lower part of the XT annulus bore 9.

Below the tool accommodation bore 118 there is a tool bore 101. The tool bore 101 is coaxially arranged with respect to the tool accommodation bore 118.

The lower part of the XT annulus bore 9 ends at a channel 19 extending radially with respect to the tool bore 101. The channel 9 connects the XT annulus bore 9 with the tool bore 101 in the XT 5.

The lower part of the tool bore 101 aligns with the upper part of the TH annulus bore 17.

In FIG. 2 and FIG. 3, a plug 200 is shown locked to a lower part of the plug tool 100. The plug tool 100 has a tool stem 103 to which the plug 200 is locked. The tool stem 103 is adapted to move axially with respect to the TH annulus bore 17. Thus, when connected to the plug 200, the tool stem 103 can move the plug 200 into and out of the TH annulus bore 17. Furthermore, the plug tool 100 can retrieve the plug 200 from a plugging position in the TH annulus bore 17. It may also install the plug 200 into such a plugging position. When in the plugging position in the TH annulus bore 17, the XT annulus bore 9 is not in fluid communication with the tubing annulus 15 (cf. FIG. 1). This position is shown in FIG. 3. FIG. 2 shows a mode where the plug 200 is retrieved by the tool 100, and pulled up to and into the tool bore 101 in the XT 5. When the plug 200 is in this parked position the XT annulus bore 9 is in fluid communication with the tubing annulus 15 through the TH annulus bore 17.

When the plug 200 is in the parking position in the tool bore 101, it is in a position above the channel 19 which connects the XT annulus bore 9 with the TH annulus bore 17.

When switching between the parked position in the tool bore 101 and the plugging position in the TH annulus bore 17, the plug 200 is moved past the channel 19.

The plug 200 is provided with seals 201 arranged to seal against the wall of the TH annulus bore 17 when in the plugging position. The plug 200 is further provided with locking dogs 203 that are adapted to be moved in and out in a radial direction. The dogs 203 are adapted to engage a facing locking profile 21 in the TH annulus bore 17 when in the plugging position. The plug 200 can be a conventional plug, as known to the person skilled in the art.

FIG. 4 to FIG. 7 are cross section views of a more realistic embodiment of the plug tool 100 arranged within a XT assembly 5 and plug 200 that can be installed in and retrieved from the TH annulus bore 17. These views are from an angle orthogonal to the cross section views of FIG. 2 and FIG. 3. In FIG. 4 to FIG. 7, the plug tool 100 is incorporated in the master valve block 5*a* of a XT. Down from the master valve block 5*a* extends an isolation sleeve 5*b*. It could also extend into an orientation sleeve in stead of the isolation sleeve 5*b*. The isolation sleeve 5*b* provides a sealed connection between the master valve block 5*a* of the XT assembly 5 and the tubing hanger 3 as well as providing correct orientation of the XT assembly 5 with respect to the tubing hanger 3. An orientation sleeve is substantially a corresponding component, however without the sealing function.

Figure 4:
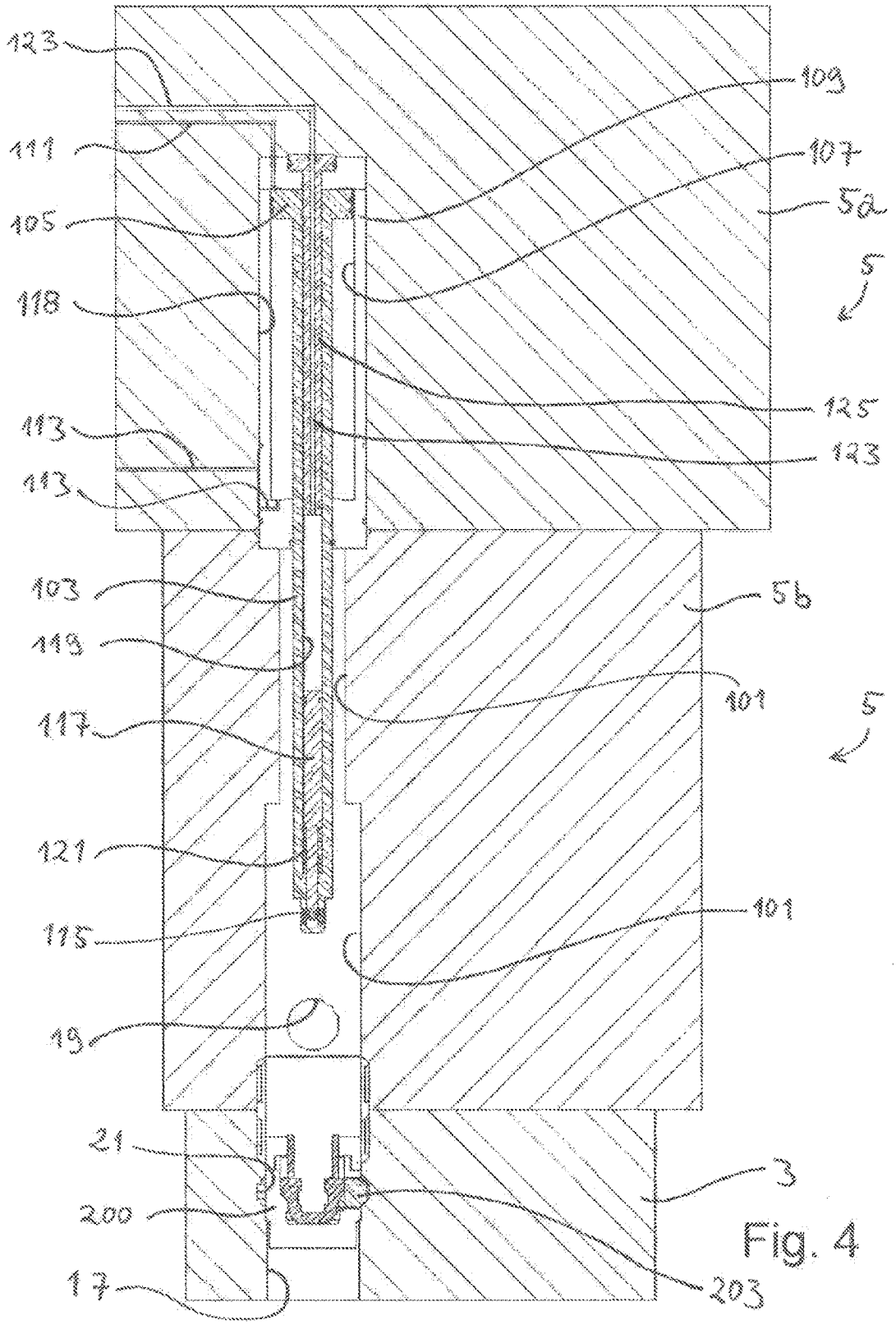
FIG. 4 is an enlarged cross section view of the XT assembly and TH, showing a plug tool incorporated in the XT main body, wherein the tool is in a retracted position.

It is first referred to FIG. 4, showing the plug 200 in the plugging position, i.e. installed in the TH annulus bore 17. The tool stem 103 is in an upper retrieved position. In this position, the tool stem 103 is retracted into the tool bore 101 in the XT assembly 5.

At its upper end, the tool stem 103 is provided with a tool piston 105. The tool piston 105 is arranged within a cylinder bore 107 of a tool cylinder 109. Hydraulic pressure can be provided on an upper face of the tool piston 105, through a hydraulic installation channel 111. Such hydraulic pressure will cause the tool stem 103 to move downwards towards the TH annulus bore 17. The hydraulic installation channel 111 extends through the XT 5 and an upper portion of the tool cylinder 109. Correspondingly, hydraulic pressure can be provided on a lower face of the tool piston 105, through a hydraulic retrieval channel 113. The hydraulic retrieval channel 113 extends through the XT 5 and a lower part of the tool cylinder 109. When pressure is applied on the lower face of the tool piston 105, the tool stem 103 will be caused to move upwards, in a retracting direction away from the TH annulus bore 17. Hydraulic pressure can be applied to the XT actuation interfaces for instance by means of an ROV, or by other means known in the art.

At a lower end of the tool stem 103 there is a stem head 115. The stem head 115 is adapted to lock to the plug 200 in a releasable manner, so that the plug 200 can be moved up and down along with the tool stem 103. For actuation of the tool head 115, i.e. for locking to the tool head 115 to the plug 200 or releasing the tool head 115 from the plug 200, there is arranged a locking plunger 117 within a stem bore 119 arranged within the tool stem 103. The locking plunger 117 can be moved down by application of hydraulic pressure in the stem bore 119 above the locking plunger 117. Between a downwardly facing shoulder of the locking plunger 117 and an upwardly facing shoulder within the stem bore 119, there is arranged a plunger spring 121 that will move the locking plunger 117 upwards when pressure above the plunger 117 is removed/reduced. Hydraulic pressure in the stem bore 119, above the locking plunger 117, is provided through a hydraulic plunger channel 123. The hydraulic plunger channel 123 extends through the XT assembly 5 and further through a plunger channel extension rod 125. The plunger channel extension rod 125 extends through an upper part of the tool cylinder 109 and further within an upper portion of the stem bore. As will appear from the cross section view of FIG. 5 the plunger channel extension rod 125 remains fixed with respect to the tool cylinder 109 when the tool stem is moved downwards.

Figure 9:
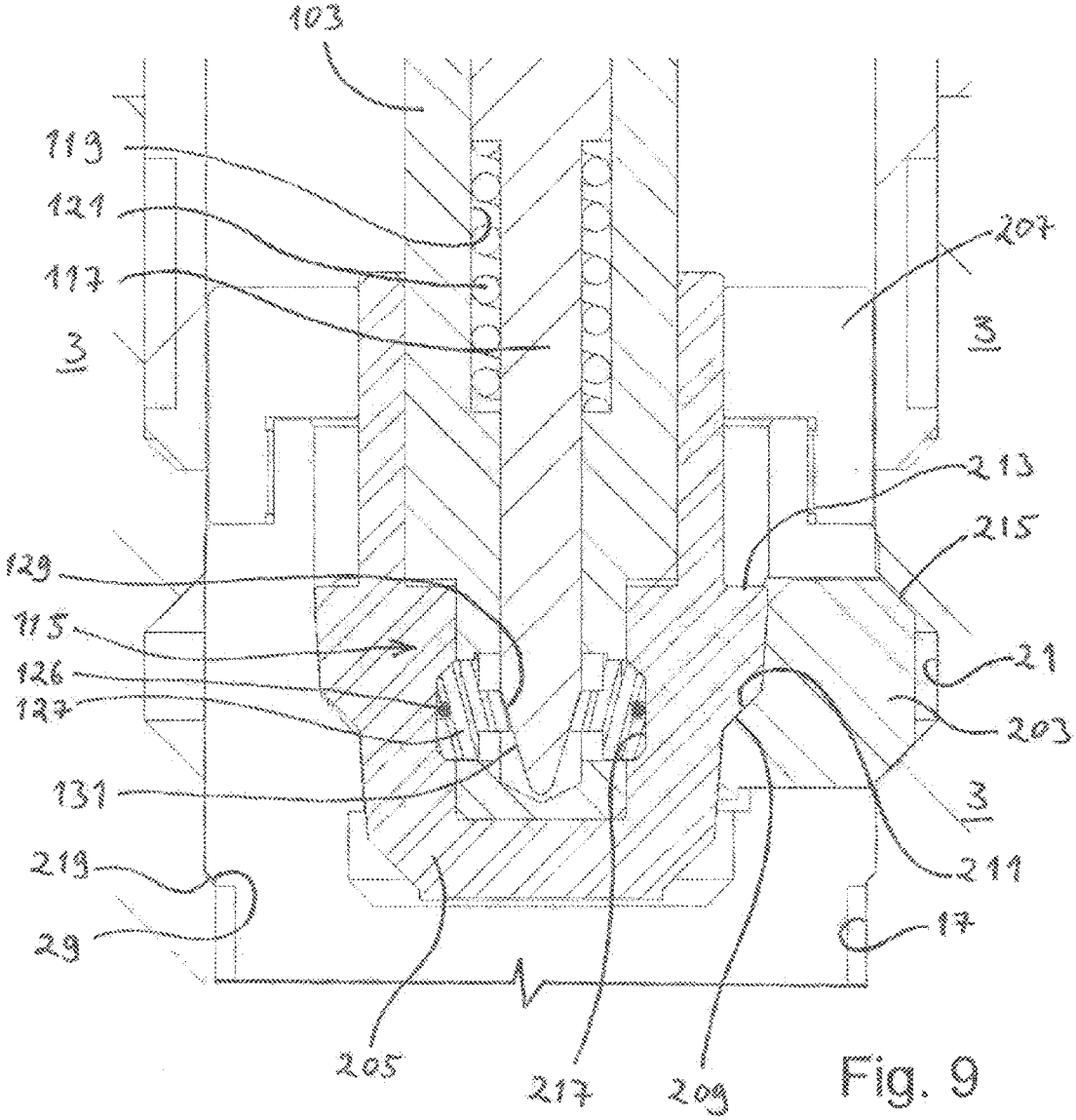
FIG. 9 is an enlarged cross section view corresponding to FIG. 8, however with the tool locked to the plug.

An alternative way of releasing the plug 200 by retraction of the stem dogs 127 will now be explained. In stead of exerting upwardly directed force on the locking plunger 117 with the plunger spring 121, the force may be provided by supplying pressure in the same annular compartment as the plunger spring 121 is arranged (cf. FIG. 9). By providing pressure in the TH annulus bore 17 in a position above the plug 200, the pressure will slip through the interface between the tool stem 103 and the plug activation sleeve 209, and further between the locking plunger 117 and the tool stem 103, and into the compartment that accommodates the plunger spring 121. FIG. 9 shows an enlarged cross section view of this compartment. The pressure will force the locking plunger 117 upwards and thus disengage the plug 200 from the locking profile 21 in the TH annulus bore 17.

Advantageously the tool cylinder 109 can be attached to the XT 5 in a releasable manner. In that way the entire plug tool 100 can be removed from the XT 5 for maintenance or replacement. The tool cylinder 109 may for instance be attached to the XT 5 by means of bolts (not shown) or welds (not shown), or any other suitable means.

In the shown embodiment, the master valve block 5*a* of the XT assembly 5 must be removed from the isolation sleeve 5*b*, in order to pull the tool cylinder 109 out of its engagement with the master valve block 5*a*. In this embodiment, the tool cylinder 109 is held in its fixed position by joining the master valve block 5*a* with the isolation sleeve 5*b*, as the tool cylinder 109 is accommodated in a tool accommodation compartment, here in the form of a tool accommodation bore 118, in the master valve block 5*a* of the XT assembly 5.

The locking sequence and unlocking sequence associated with the stem head 115 and the plug 200 will be described later with reference to FIG. 8 and FIG. 9.

Below the stem head 115 in FIG. 4, channel 19 is indicated. The channel 19 connects the XT annulus bore 9 with the TH annulus bore 17 (cf. FIG. 2 and FIG. 3).

Figure 5:
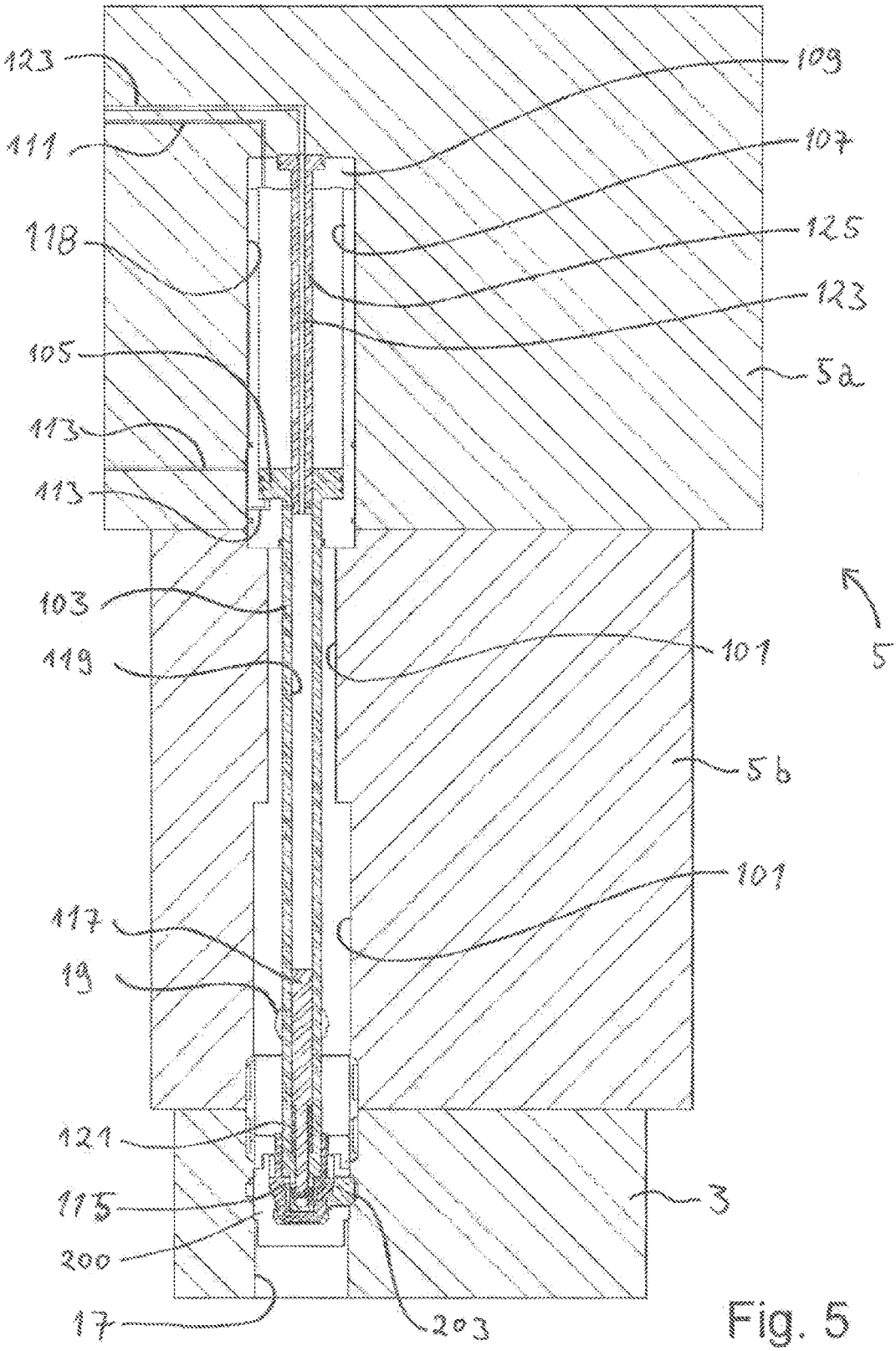
FIG. 5 is a cross section view corresponding to FIG. 4, wherein the tool is in an extended position.

FIG. 5 is a view corresponding to the cross section view of FIG. 4, however with the tool stem 103 in a lower position. In this lower position the stem head 115 is in a position to engage the plug 200 by activation of the locking plunger 117. Here, the tool piston 105 is in its lowest possible position within cylinder bore 107.

Figure 6:
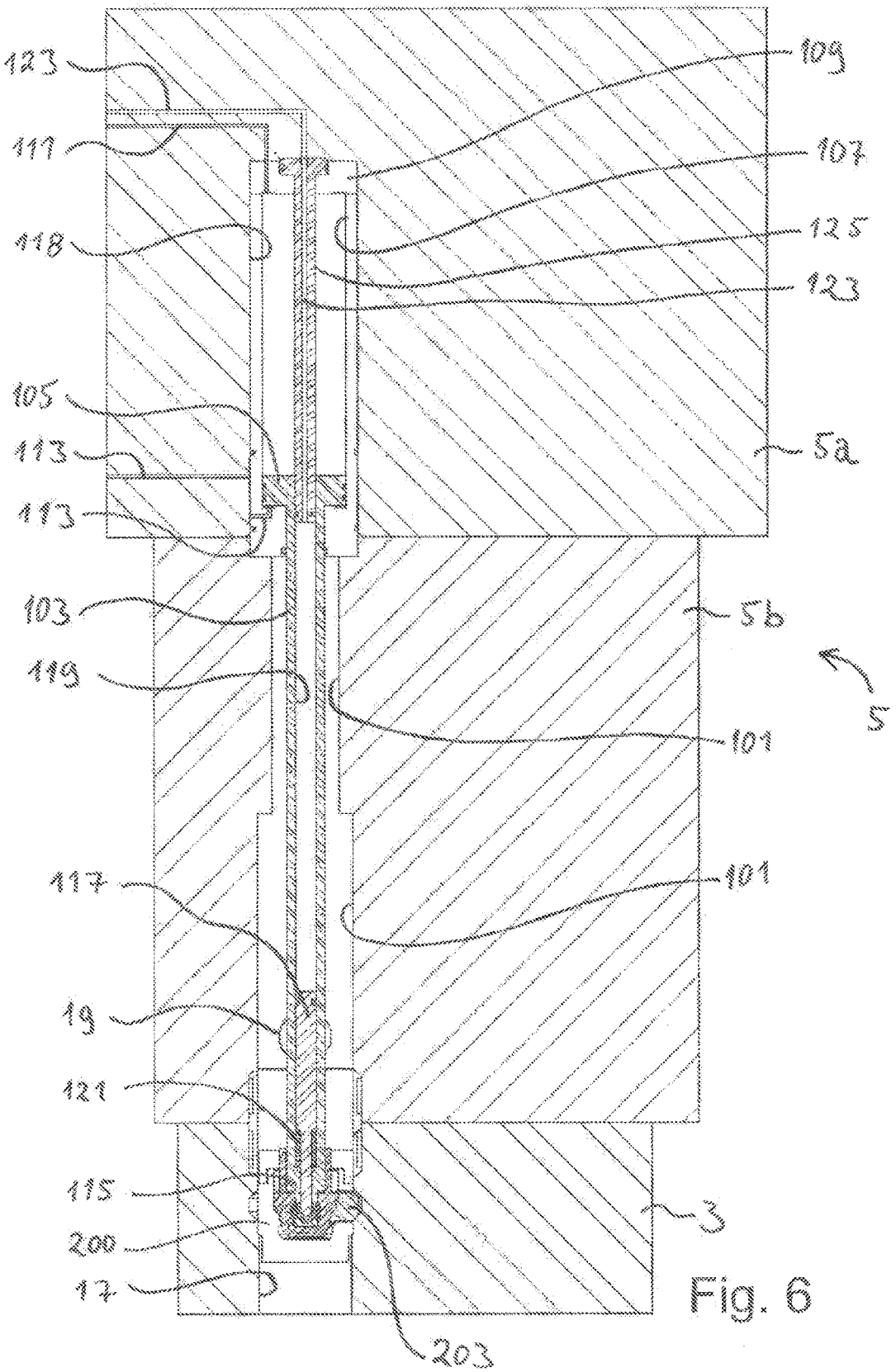
FIG. 6 is a cross section view corresponding to FIG. 4, wherein the tool is in an extended position and in engagement with a plug locked in the TH annulus bore.

In the mode shown in FIG. 6, the tool stem 103 is in the same position as shown in FIG. 5. However hydraulic pressure has been provided in the stem bore 119 above the locking plunger 117, thereby forcing the locking plunger 117 downwards. This downward movement of the locking plunger 117 results in that the stem head 115 locks to the plug 200. This sequence will be described below with reference to FIG. 8 and FIG. 9. The tool 100 is now in a mode where it can pull the plug 200 in an upward direction. This pull will release the locking dogs 203 of the plug 200 from their engagement with the locking profile 21 in the TH annulus bore 17.

If the tool 100 is used to install the plug 200 in the TH annulus bore 17, a downwardly directed force is exerted onto the plug 200 from the tool stem 103. This force actuates the locking dogs 203 of the plug 200 into a locking engagement with the locking profile 21 of the TH annulus bore 17. Then, after activation of the locking dogs 203, hydraulic pressure in the stem bore 119, above the locking plunger 117 is removed, thereby allowing the plunger spring 121 to move the plunger 117 upwards. The upward movement of the plunger 117 will release the stem head 115 from the plug 200. Then, the tool stem 103 will be moved upward and parked within the tool bore 101, while the plug 200 is in its installed position in the TH annulus bore 17.

Figure 7:
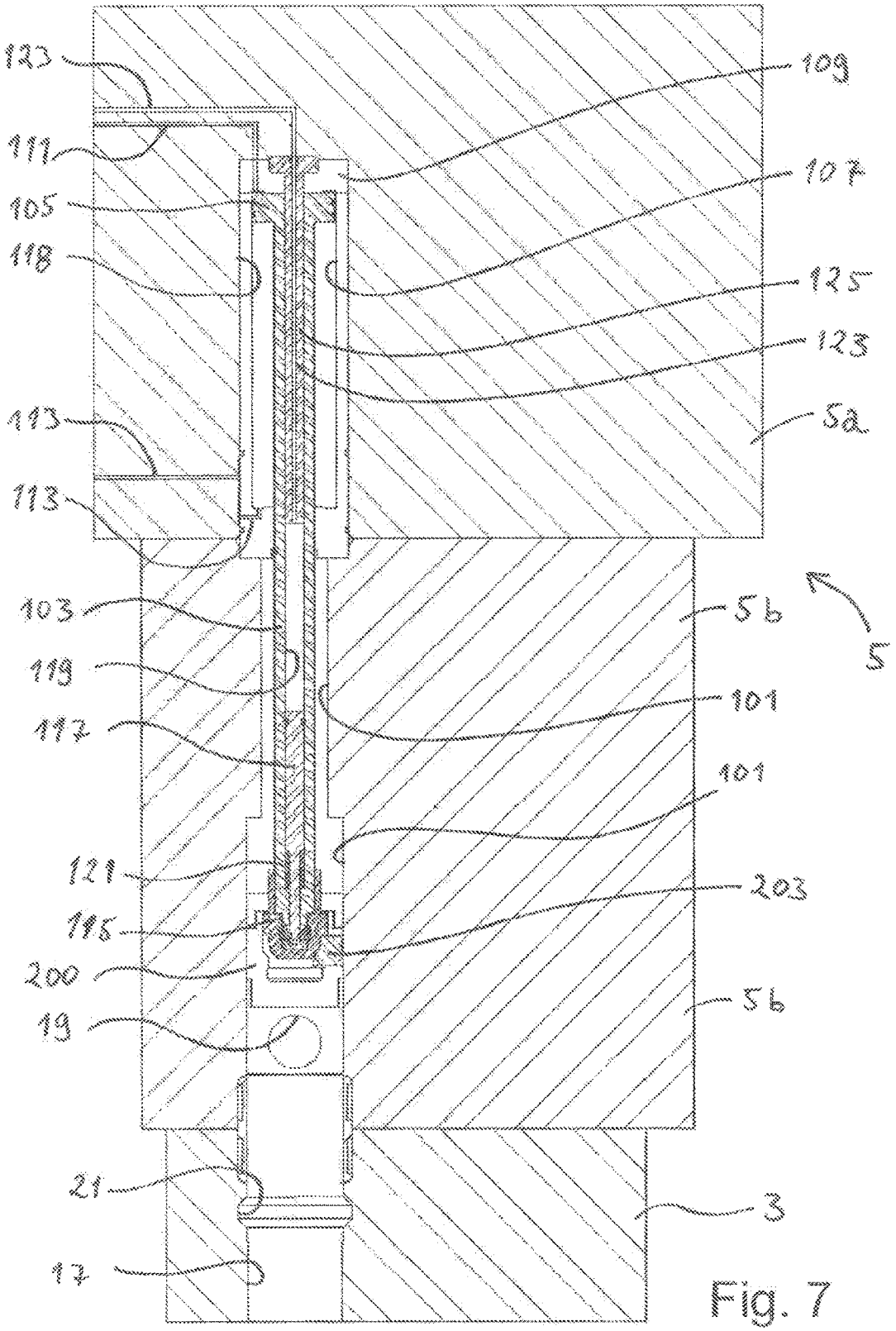
FIG. 7 is a cross section view corresponding to FIG. 4, wherein the tool is locked to the plug and in a retracted position.

FIG. 7 illustrates the mode where the stem head 115 is locked to the plug 200 and retracted into its parked position within the tool bore 101. When the plug 200 is in this parked position, there is fluid communication between the XT annulus bore 9 and the tubing annulus 15, through the TH annulus bore 17.

Figure 8:
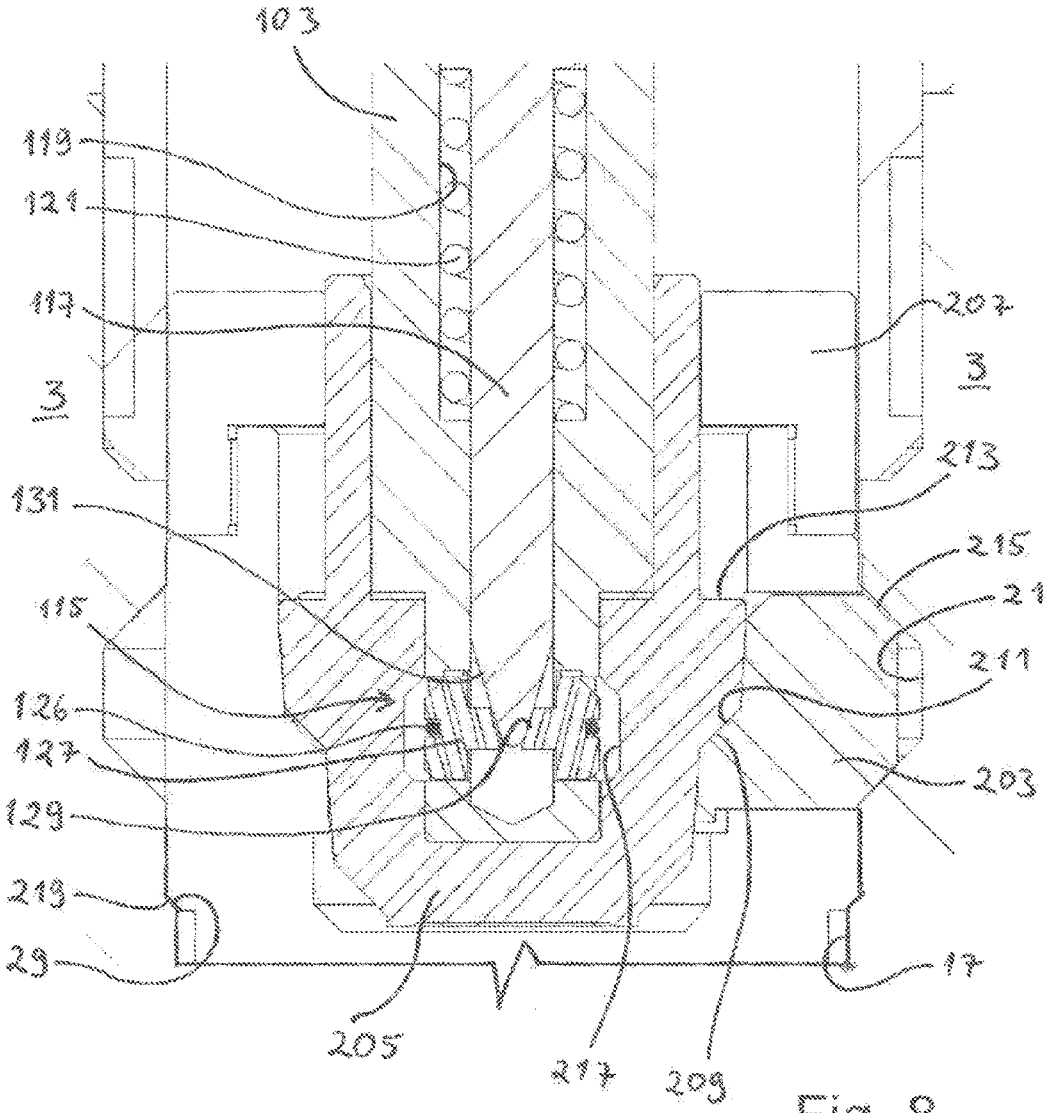
FIG. 8 is an enlarged cross section view of the plug installed within the TH annulus bore and with a lower end of the tool in the position of the plug, corresponding to FIG. 5.

FIG. 8 and FIG. 9 are enlarged cross section views of the upper part of the plug 200, the lower part of the tool stem 103, and the stem head 115. In both views the plug 200 is in its plugging position, installed in the TH annulus bore 17. The plug dogs 203 are in engagement with the locking profile 21.

In the position illustrated in FIG. 8, the stem head 115 is in a position ready to lock to the plug 200. The plug 200 exhibits a plug actuation sleeve 205 which is adapted to move a limited distance axially up and down within a plug main body 207.

On a radial outer face of the plug actuation sleeve 205, it exhibits an inclined sleeve actuation face 209. The sleeve actuation face 209 is adapted to slide against facing dog actuation faces 211 on the radial inwardly facing side of the plug locking dogs 203. Thus, by moving the plug actuation sleeve 205 downwards, the plug 200 locks to the locking profile 21 of the TH annulus bore 17.

When pulling the plug actuation sleeve 205 upwards, a plug actuation sleeve shoulder 213 abuts a downwardly facing shoulder of the plug main body 207. This makes the plug main body 207 exert upwardly directed force on the plug locking dogs 203. An inclined release face 215 on the locking dog 203 abuts and slides against a facing inclined face of the locking profile 21. As a result, the locking dogs 203 are moved radially inwards as the plug main body 207 is pulled upwards by means of the tool stem 103.

In the situation illustrated in FIG. 8, the stem head 115 is not locked to the plug 200. The plug actuation sleeve 205 exhibits an inwardly facing sleeve locking profile 217 which is adapted to receive radially movable stem dogs 127. The stem dogs 127 are supported in the lower portion the tool stem 103 (stem head 115). At their radially inner portion, the stem dogs 127 exhibit an inclined stem dog actuation face 129 that are adapted to slide against a facing plunger actuation face 131. When the plunger 117 is moved down, the stem dogs 127 are thus moved radially outwards into engagement with the sleeve locking profile 217. In this engaged position the stem head 115 is locked to the plug activation sleeve 205 and thus to the plug 200. Such a situation is shown in FIG. 9.

In lieu of stem dogs 127, one can also imagine other types of stem locking means 127.

FIG. 9 shows the plunger 117 in a lower position, wherein the stem dogs 127 are in a locking engagement with the plug actuation sleeve 205. When in this mode, pulling the tool stem 103 upwards will release the plug 200 from the TH annulus bore 17.

To ensure retraction of the stem dogs 127 from the radially expanded position shown in FIG. 9, a retainer ring 126 in the form of a split ring is arranged in a groove in the stem dogs 127. The retainer ring 126 is sufficiently resilient to let the stem dogs 127 expand into the engaged position, but will retract the stem dogs 127 once the locking plunger 117 is withdrawn (pulled upwards in FIG. 8 and FIG. 9).

When the plug 200 is moved from its parked position within the tool bore 101, downwards into its plugging position, a plug shoulder 219 will abut a landing shoulder 29 arranged within the TH annulus bore 17. An additional downward movement of the tool stem 103 will actuate the plug locking dogs 203, as explained above, by means of the plug actuation sleeve 205. Once locked, the locking plunger 117 is moved upwards. When pulling the tool stem 103 upwards, with the locking plunger 117 in an upper position, the stem dogs 127 will be moved radially inwards as a result of oppositely arranged sliding surfaces on the stem dogs 127 and the sleeve locking profile 217, respectively. Thereby the locked engagement between the stem head 115 and the plug 200 will be released. The tool stem 103 can then be moved back up into the tool bore 101 with the plug 200 remaining locked in its plugging position within the TH annulus bore 17.

Figure 10:
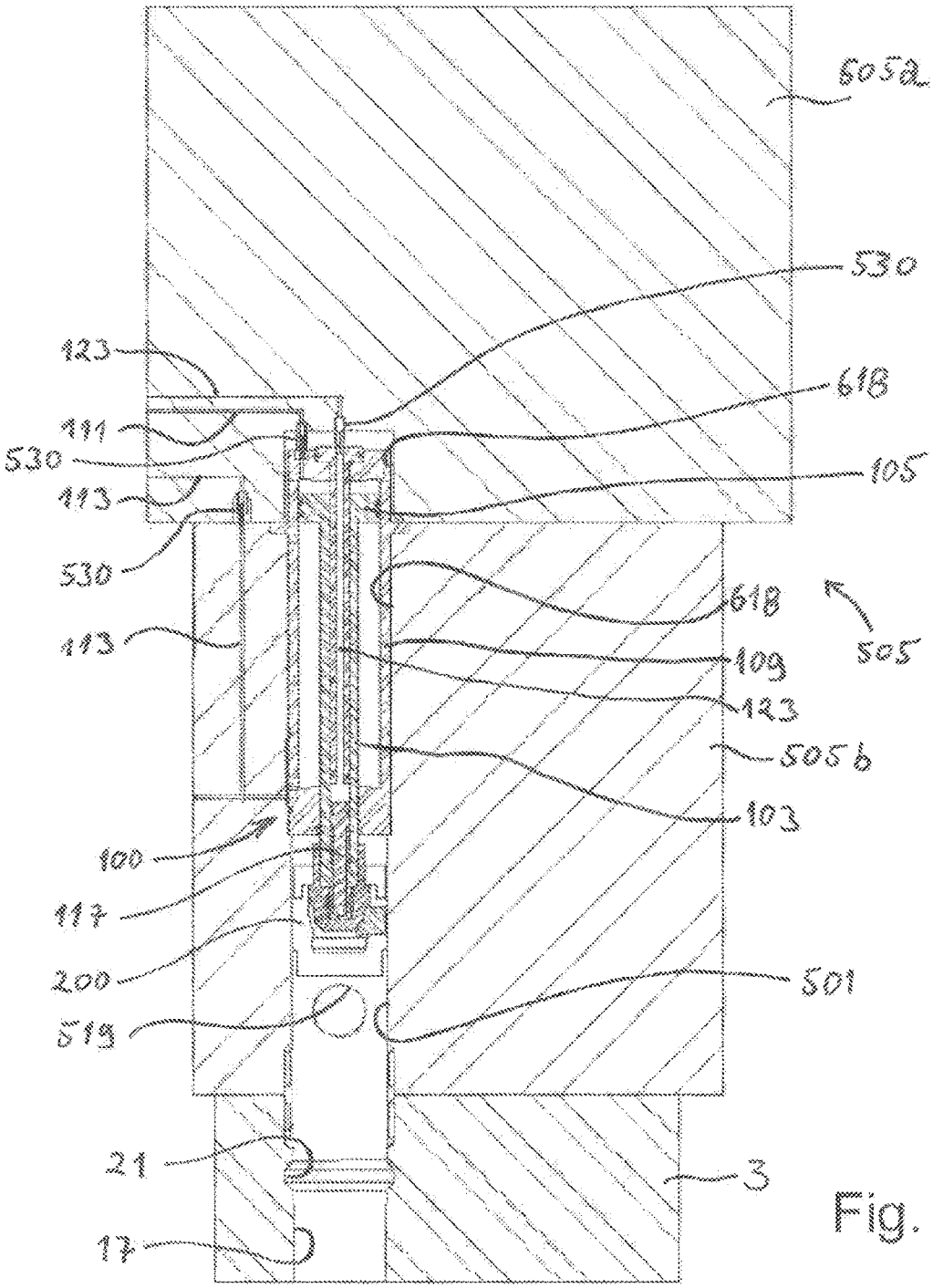
FIG. 10 is a cross section view of an alternative embodiment of the present invention.
Figure 11:
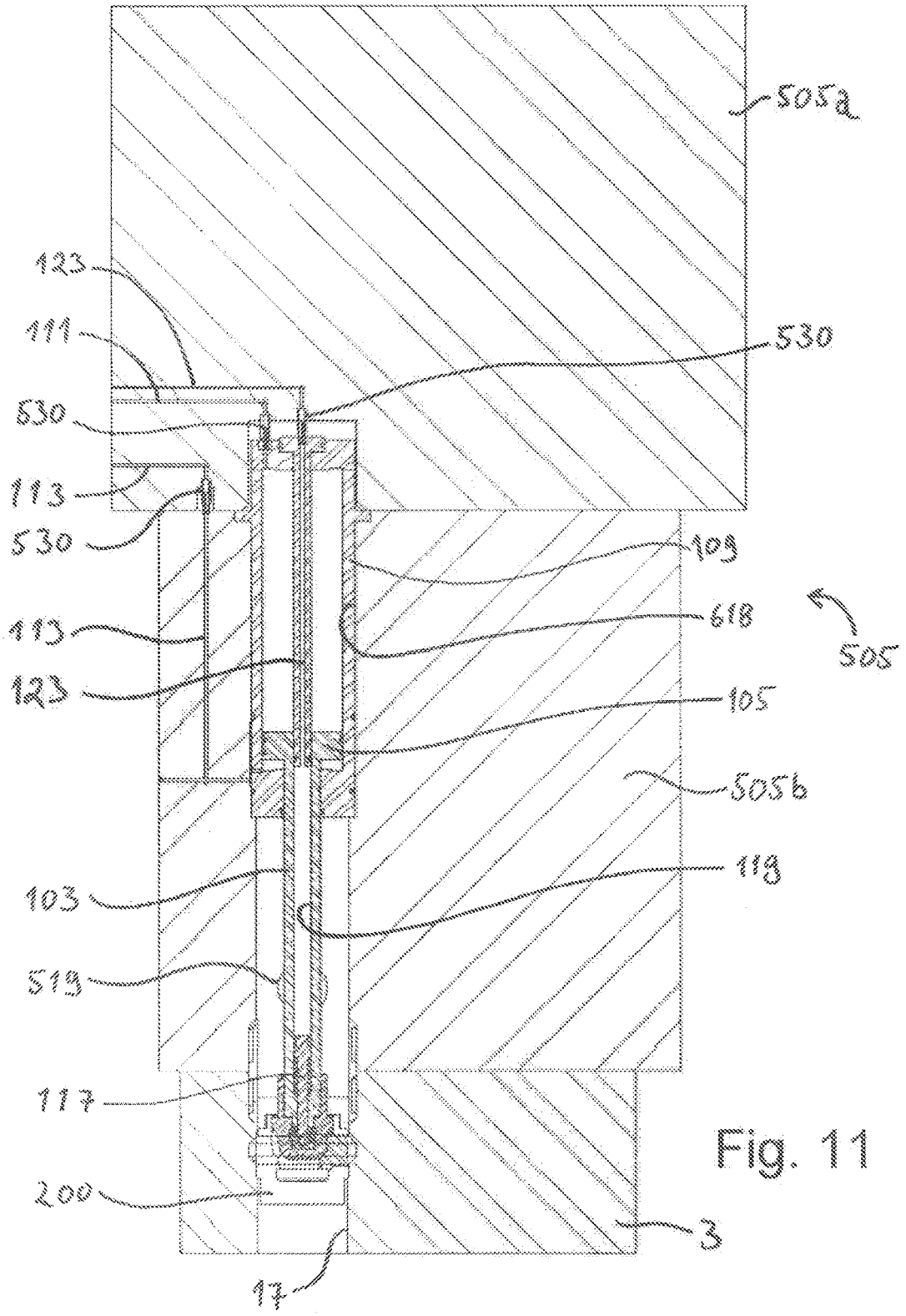
FIG. 11 is a view corresponding to FIG. 10, however in another situation.
Figure 12:
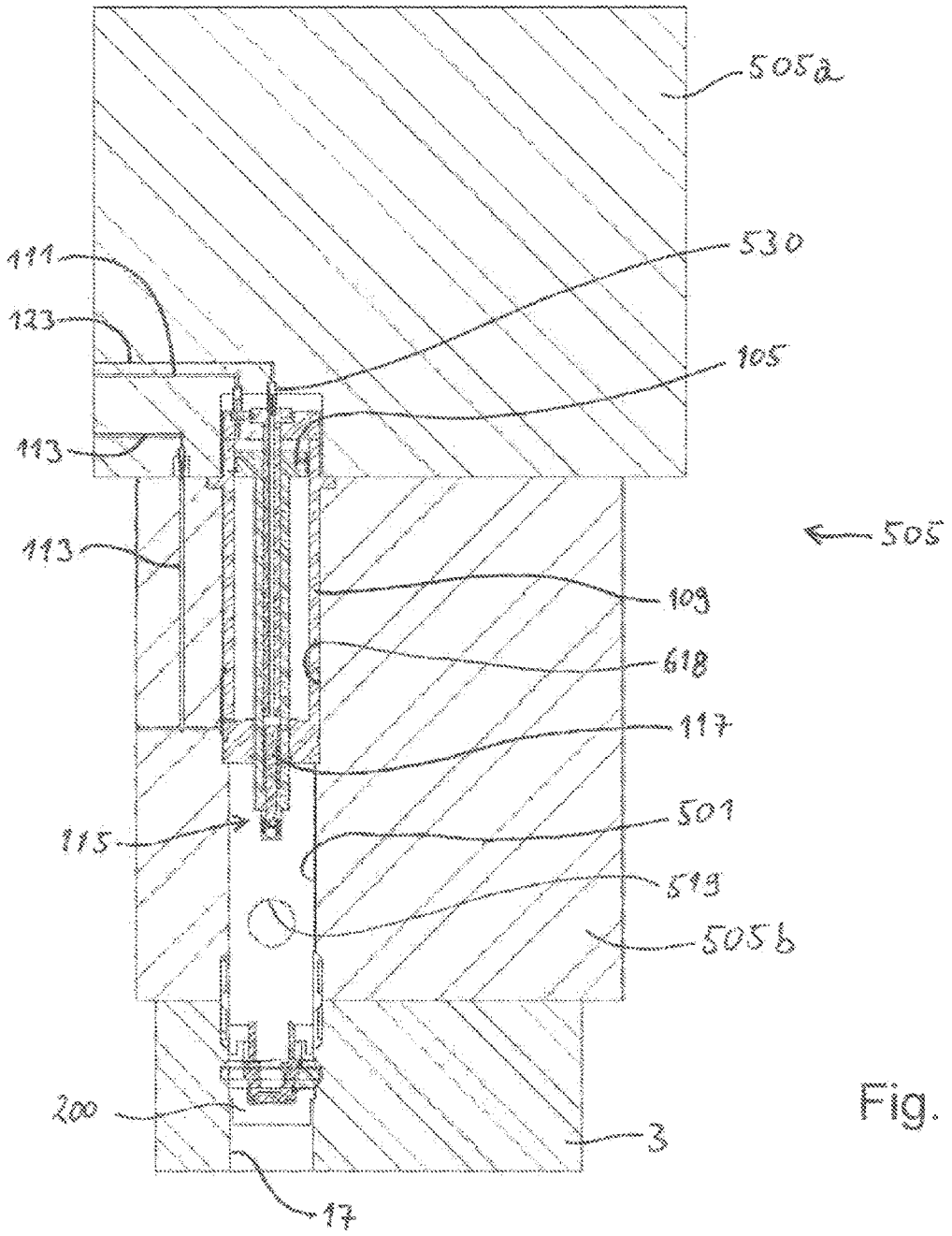
FIG. 12 is also a view corresponding to FIG. 11, in yet another situation.

FIG. 10, FIG. 11, and FIG. 12 show an alternative embodiment of the present invention. In this embodiment, having a master valve block 505*a* and an isolation sleeve 505*b* attached below it, the tool accommodation bore 618 is arranged in the isolation sleeve 505*b*. As a result the hydraulic retrieval channel 113 extends through a portion of the isolation sleeve 505*b*. An upper part of the hydraulic retrieval channel 113 does however extend through the master valve block 505*a*, as in the embodiment shown in FIG. 4 to FIG. 7.

As appears from the drawings (cf. FIG. 10), arranging the plug tool 100 in a tool accommodation bore 618 in the isolation sleeve 505*b* results in that the tool 100 is closer to the tubing hanger 3 and hence the TH annulus bore 17. This further results in that the tool stem 103 can be made shorter than in the embodiment described with reference to FIG. 4 to FIG. 7.

FIG. 10 shows the plug tool 100 attached to the plug 200 and in a parking position, i.e. with the TH annulus bore 17 being open for fluid communication. FIG. 11 shows a corresponding drawing, however with the plug 200 installed in the TH annulus bore 17. FIG. 12 also shows a corresponding drawing, however with the plug 200 installed in the TH annulus bore 17 and the tool stem 103 retracted into the XT assembly 505.

Figure 13:
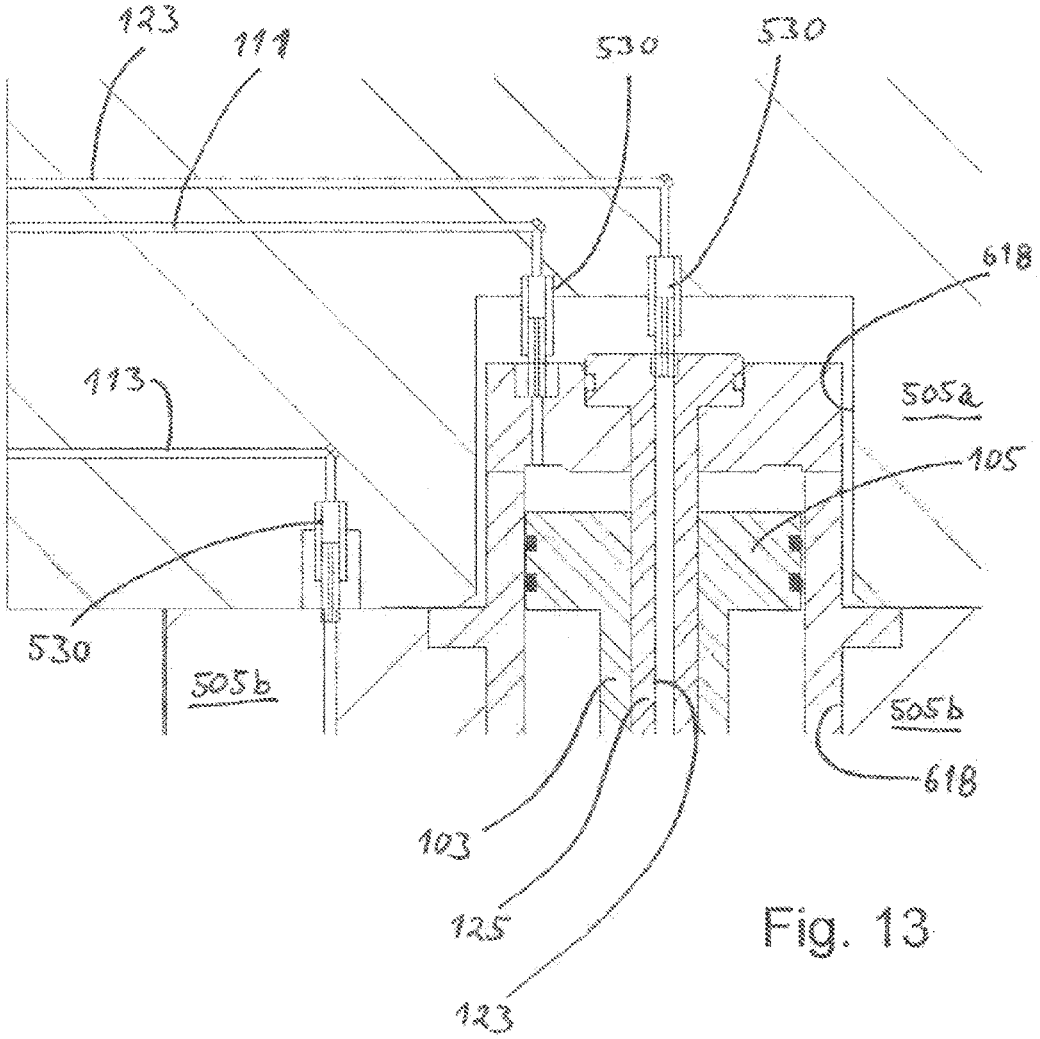
FIG. 13 is an enlarged cross section view of an interface between a XT master valve block and an isolation sleeve.

The hydraulic retrieval channel 113 extends from the master valve block 505*a* to the isolation sleeve 505*b* through a hydraulic coupler 530. Hydraulic couplers 530 are also arranged in the interface between the plug tool 100 and the hydraulic installation channel 111 and the hydraulic plunger channel 123. These interfaces are shown more clearly in FIG. 13.

In the embodiment shown in FIG. 10 to FIG. 13, the tool accommodation bore 618 is substantially accommodated in the isolation sleeve 505*b*. However, in this embodiment an upper portion of the tool bore 618 extend into a portion of the master valve block 505*a* of the XT assembly 505.

As appears from the drawings in FIG. 10 to FIG. 13, the plug tool 100 in this embodiment is substantially the same as the plug tool 100 shown in the embodiment depicted tin FIG. 4 to FIG. 7. A further description of the latter embodiment is thus superfluous.

The invention claimed is:

1. A subsea Xmas tree assembly comprising:

a Xmas tree main bore;

a Xmas tree annulus bore;

wherein the Xmas tree main bore is adapted to align with a tubing hanger main bore and the Xmas tree annulus bore is adapted to communicate with a tubing hanger annulus bore when the subsea Xmas tree assembly is installed above a tubing hanger of a subsea well;

a plug tool adapted to install and to retrieve a plug into and out of the tubing hanger annulus bore when the Xmas tree assembly is installed above the tubing hanger; and a tool accommodation compartment within which the plug tool is arranged.

2. The subsea Xmas tree assembly according to claim 1, wherein the plug tool comprises a tool stem which is adapted to be moved towards and away from the tubing hanger annulus bore, in an axial direction with respect to the tubing hanger annulus bore.

3. The subsea Xmas tree assembly according to claim 2, wherein the tool stem is supported in a tool cylinder accommodated by the subsea Xmas tree assembly.

4. The subsea Xmas tree assembly according to claim 3, wherein the tool cylinder comprises a cylinder bore within which a tool piston is arranged, the tool piston being connected to the tool stem, wherein movement of the tool piston and tool stem is provided by supply of hydraulic pressure above or below said tool piston.

5. The subsea Xmas tree assembly according to claim 2, wherein a lower part of the tool stem comprises a locking plunger arranged within a stem bore in the tool stem, wherein the locking plunger is adapted to be moved downwards with respect to the tool stem by application of hydraulic pressure in the stem bore above the locking plunger, and wherein the locking plunger is adapted to activate stem locking means for locking the tool stem to the plug when the locking plunger is moved downwards.

6. The subsea Xmas tree assembly according to claim 5, wherein the stem locking means comprises a stem dog exhibiting an inclined stem dog actuation face that is adapted to slide against a plunger actuation face of the locking plunger.

7. The subsea Xmas tree assembly according to claim 1, wherein a tool cylinder is releasably fixed to the Xmas tree assembly.

8. The subsea Xmas tree assembly according to claim 1, wherein the plug may take a plug parking position in which the plug is maintained during fluid communication between the Xmas tree annulus bore and the tubing annulus, which parking position is within a tool bore that aligns with the tubing hanger annulus bore, and wherein the parking position is above a channel in the Xmas tree assembly which connects the subsea Xmas tree annulus bore with the tool bore.

9. The subsea Xmas tree assembly according to claim 1, comprising an isolation sleeve or an orientation sleeve arranged below a Xmas tree master valve block, and wherein the plug tool is arranged in the Xmas tree master valve block.

10. The subsea Xmas tree assembly according to claim 1, comprising an isolation sleeve or an orientation sleeve arranged below a Xmas tree master valve block, and wherein the plug tool is arranged in the isolation sleeve or the orientation sleeve.

11. A method of opening for fluid communication between a Xmas tree annulus bore and a tubing annulus of a subsea well through a tubing hanger annulus bore of a tubing hanger, the method comprising:

a) landing a Xmas tree assembly on said subsea well, above the tubing hanger;

b) with a plug tool arranged within a tool accommodation compartment of the Xmas tree assembly, connecting the plug tool to a plug installed in the tubing hanger annulus bore; and c) with the plug tool, releasing the plug from the tubing hanger annulus bore and pulling it up from the tubing hanger annulus bore and into the Xmas tree assembly.

12. The method according to claim 11, characterized in that wherein step b) comprises:

i) lowering a tool stem down to a position of the plug; and ii) activating a stem locking means to lock a stem head to the plug.

13. The method according to claim 12, wherein step i) comprises supplying hydraulic pressure above a tool piston connected to the tool stem.

14. The method according to claim 11, wherein step c) comprises retrieving the plug into a tool bore that aligns with the tubing hanger annulus bore.

* * * * *

UNITED STATES PATENT AND TRADEMARK OFFICE

CERTIFICATE OF CORRECTION

PATENT NO. : 9,353,592 B2
APPLICATION NO. : 14/440055
DATED : May 31, 2016
INVENTOR(S) : Jarmo Kekarainen It is certified that error appears in the above-identified patent and that said Letters Patent is hereby corrected as shown below:

In the Claims

Column 10, Claim 12, Lines 29-30, Replace "The method according to claim 11, characterized in that wherein step b) comprises:" with -- The method according to claim 11, wherein step b) comprises: --

Signed and Sealed this
Second Day of August, 2016

Michelle K. Lee

Michelle K. Lee
*Director of the United States Patent and Trademark Office*